US008276412B2

(12) United States Patent
Ramsauer

(10) Patent No.: US 8,276,412 B2
(45) Date of Patent: Oct. 2, 2012

(54) RECESSED GRIP

(76) Inventor: Dieter Ramsauer, Schwelm (DE)

( * ) Notice: Subject to any disclaimer, the term of this patent is extended or adjusted under 35 U.S.C. 154(b) by 683 days.

(21) Appl. No.: 11/596,689

(22) PCT Filed: May 17, 2005

(86) PCT No.: PCT/EP2005/004768

§ 371 (c)(1),
(2), (4) Date: Nov. 15, 2006

(87) PCT Pub. No.: WO2005/113922

PCT Pub. Date: Dec. 1, 2005

(65) Prior Publication Data

US 2008/0216284 A1 Sep. 11, 2008

(30) Foreign Application Priority Data

May 17, 2004 (DE) ..... 20 2004 008 059 U

(51) Int. Cl.
*E05B 13/10* (2006.01)
*E05B 3/00* (2006.01)

(52) U.S. Cl. ..... 70/208; 70/215; 70/224; 292/336.3; 292/DIG. 38

(58) Field of Classification Search ..... 70/207, 70/208, 210, 215, 224, 370, 371; 292/194, 292/195, 336.3, DIG. 63, DIG. 68, DIG. 38, 292/DIG. 53; 16/110.1, 415, DIG. 19, DIG. 25, 16/416, 425; 312/320, 244, 330; 220/3.2–3.6; 296/1.02, 56, 57.1, 106, 214; D8/300, 313
See application file for complete search history.

(56) References Cited

U.S. PATENT DOCUMENTS

| | | | | | |
|---|---|---|---|---|---|
| 1,304,700 | A | * | 5/1919 | Otte | 16/412 |
| D132,687 | S | * | 6/1942 | Kupperman | D8/313 |
| 2,793,386 | A | * | 5/1957 | Muhlhauser | 16/416 |
| 3,098,686 | A | * | 7/1963 | Benoit | 312/348.6 |
| 3,190,092 | A | * | 6/1965 | Patriquin | 70/370 |
| 3,357,733 | A | * | 12/1967 | Heifetz | 292/165 |
| 4,063,660 | A | * | 12/1977 | Ware | 220/3.6 |
| 4,093,327 | A | * | 6/1978 | Linger | 312/244 |

(Continued)

FOREIGN PATENT DOCUMENTS

| | | |
|---|---|---|
| DE | 41 30 818 | 3/1993 |

(Continued)

*Primary Examiner* — Carlos Lugo
*Assistant Examiner* — Alyson M Merlino
(74) *Attorney, Agent, or Firm* — Frommer Lawrence & Haug LLP

(57) ABSTRACT

The description relates to a grip trough to be installed in a rectangular opening of a thin wall such as a sheet-metal wall or door leaf of a sheet-metal cabinet. The trough has a base and four side walls proceeding therefrom, which four side walls run into a rectangular flange-like rim which surrounds the bearing surface of the opening in the thin wall in the installed state. Two shorter, oppositely located side walls extend substantially parallel to one another and extend perpendicular to the thin wall, while the two other, longer side walls are oriented diagonally at an acute angle and obtuse angle, respectively, relative to the thin wall. Wall webs project in direction of the thin wall from the side wall extending at an obtuse angle to the thin wall. According to the invention, at least one receptacle for a closure device, such as a closing cylinder with a sash fastener, is provided in the area of the side wall that extends at an acute angle to the thin wall.

10 Claims, 3 Drawing Sheets

U.S. PATENT DOCUMENTS

| | | | | | |
|---|---|---|---|---|---|
| 4,370,874 | A | | 2/1983 | Munn | |
| 4,609,119 | A | * | 9/1986 | Richter, Sr. | 220/3.5 |
| 4,623,110 | A | * | 11/1986 | Kanari | 248/27.1 |
| 4,850,209 | A | | 7/1989 | Weinerman et al. | |
| 4,875,726 | A | * | 10/1989 | Thau | 292/337 |
| 4,909,551 | A | * | 3/1990 | Buchanan | 292/175 |
| 4,910,982 | A | * | 3/1990 | Dana | 70/370 |
| 5,134,754 | A | * | 8/1992 | Vickers | 16/416 |
| 5,183,302 | A | * | 2/1993 | Pelachyk et al. | 292/336.3 |
| 5,211,580 | A | * | 5/1993 | Schuplin | 439/538 |
| 5,251,467 | A | * | 10/1993 | Anderson | 70/370 |
| D349,338 | S | * | 8/1994 | Crinion | D23/386 |
| D349,838 | S | * | 8/1994 | Barton et al. | D8/313 |
| 5,606,882 | A | | 3/1997 | Larsen et al. | |
| 5,758,454 | A | * | 6/1998 | Trap et al. | 49/506 |
| 5,927,836 | A | * | 7/1999 | Herr et al. | 312/244 |
| 6,093,890 | A | * | 7/2000 | Gretz | 174/58 |
| D436,832 | S | * | 1/2001 | Matsuo et al. | D8/313 |
| 6,209,366 | B1 | * | 4/2001 | Zagoroff | 70/208 |
| D442,846 | S | * | 5/2001 | Bastian | D8/313 |
| 6,318,026 | B1 | * | 11/2001 | Ayres et al. | 49/503 |
| 6,346,674 | B1 | * | 2/2002 | Gretz | 174/58 |
| 6,490,894 | B1 | * | 12/2002 | Laurent | 70/208 |
| D488,991 | S | * | 4/2004 | Bertani | D8/313 |
| D491,045 | S | * | 6/2004 | Laabs et al. | D8/343 |
| 6,854,304 | B2 | * | 2/2005 | Linares | 70/208 |
| 7,468,487 | B1 | * | 12/2008 | Murphy | 174/58 |
| 7,595,446 | B2 | * | 9/2009 | Turcovsky et al. | 174/50 |

FOREIGN PATENT DOCUMENTS

| | | |
|---|---|---|
| DE | 297 20 992 | 5/1999 |

* cited by examiner

RECESSED GRIP

CROSS-REFERENCE TO RELATED APPLICATIONS

This application claims priority of International Application No. PCT/EP2005/004768, filed May 3, 2005 and German Application No. 20 2004 008 059.1, filed May 17, 2004, the complete disclosures of which are hereby incorporated by reference.

BACKGROUND OF THE INVENTION a) Field of the Invention

The invention is directed to a grip trough to be installed in a rectangular opening of a thin wall such as a sheet-metal wall or the door leaf of a sheet-metal cabinet, wherein the trough has a base and four side walls proceeding therefrom, which four side walls run into a rectangular flange-like rim which surrounds the bearing surface of the opening in the thin wall in the mounted state, wherein two shorter, oppositely located side walls extend substantially parallel to one another and extend perpendicular to the thin wall, while the two other, longer side walls are oriented diagonally at an acute angle and obtuse angle, respectively, relative to the thin wall, wherein wall webs project in direction of the thin wall from the side wall extending at an obtuse angle to the thin wall.

b) Description of the Related Art

A grip trough of the kind mentioned above is already known from DE 297 20 992 U1. A disadvantage in the prior art consists in that, in addition to the grip that is formed by the grip trough, the door leaf of a sheet-metal cabinet also needs a closure device and therefore also requires another opening in order to hold the door in the closed position.

SUMMARY AND OBJECT OF THE INVENTION

In order to facilitate mounting and to reduce the number of parts to be mounted and the number of openings needed in the door leaf, a primary object of the invention is to provide a grip trough in which a closure device is already integrated.

The above-stated object is met in that at least one receptacle for a closure device, such as a closing cylinder with a sash fastener, is provided in the area of the side wall that extends at an acute angle to the thin wall.

This step provides a unit formed of the grip trough and closure device which requires only one rectangular opening in the thin wall such as a door leaf but not a second opening for a closure device. Also, mounting is simplified because it is no longer necessary to mount two different objects, namely, a grip trough and a closure device, in the door; rather, both fitting parts can be mounted simultaneously as one unit.

According to a further development of the grip trough, the closing cylinder is arranged in such a way that it projects by its shaft end through an opening in the base of the grip trough and carries a sash fastener tongue on its projecting end, and this sash fastener tongue is capable of engaging with a rear-engagement surface of a door frame or the like. This is a particularly simple embodiment form and can be realized in a particularly advantageous manner with respect to its construction. The door is locked in that the sash fastener tongue or the lock latch locks on the rear-engagement surface of a door frame or the like in the locked state.

The receiving space for the closing cylinder can be provided near the center of the side wall that extends at an acute angle to the thin wall, but it is usually better and advantageous, particularly with respect to the space required by the hand for reaching into the trough, when the receiving space for the closing cylinder is arranged near one end of the side wall which extends at an acute angle to the thin wall. Further, to facilitate switching from right to left, it is advantageous when two receiving spaces, namely, a receiving space for each closing cylinder, is provided, respectively, near one end and near the other end of the side wall extending at an acute angle to the thin wall. One location for arranging the closing cylinder will be better than the other depending on whether the door is fastened on the right-hand side or left-hand side. One closing cylinder is generally sufficient. The remaining receiving space for the other closing cylinder can then be closed by a filler plug.

According to another further development of the grip trough according to the invention, the base is constructed so as to spring back in the area of the receiving spaces provided at the ends of the side wall extending at an acute angle to the thin wall by an amount such that a stop face is formed for the rotating movement of the tongues. This ensures particularly easy operation because the stop face furnishes a definite closed position and open position.

It is usually also advantageous when the base springs back by an amount such that the tongue and, optionally, holding means for holding the tongue on the end of the shaft of the closing cylinder, such as a retaining ring, nut, pin or the like, and also the end of the shaft are received in their entirety or almost in their entirety and do not extend beyond the alignment plane of the rest of the base wall that does not spring back. This results in a particularly compact construction.

The grip trough is locked and held in the door leaf in a particularly effective manner when the webs projecting from the wall that is arranged at an obtuse angle to the sheet-metal wall in direction of the thin wall are bent at the free end and are supported on the inner rim surface of the opening by these bent portions. This also facilitates mounting because these bent structural component parts are flexible and can accordingly also be mounted in a particularly easy manner.

The grip trough is advisably injection-molded from plastic in one piece in order to achieve this spring force for the material.

BRIEF DESCRIPTION OF THE DRAWINGS

The invention will be explained more fully in the following with reference to embodiment examples shown in the drawings.

DESCRIPTION OF THE PREFERRED EMBODIMENTS

Figure 1A:
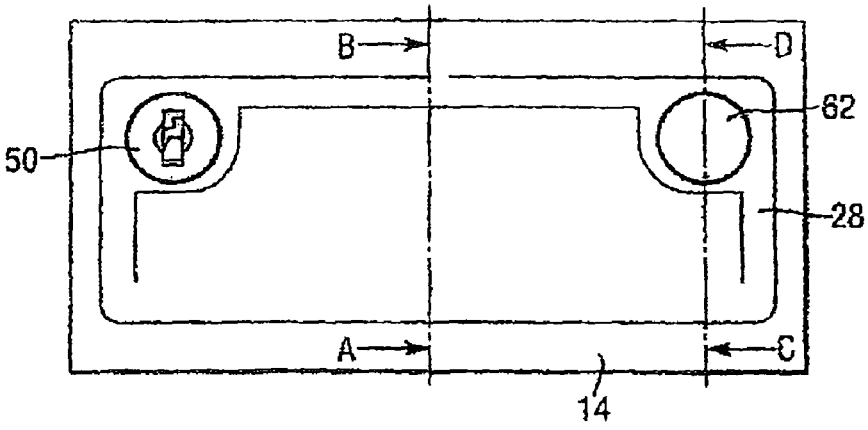
FIG. 1A shows a top view of a grip trough according to the invention.
Figure 1B:
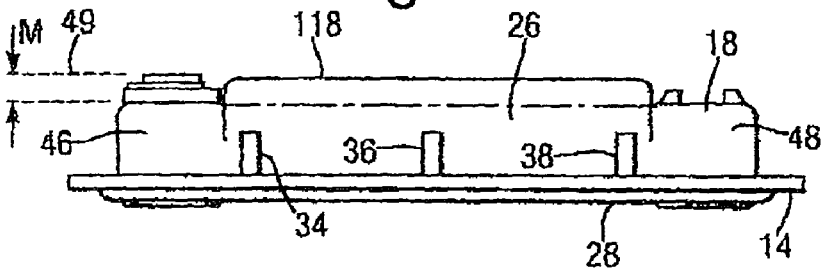
FIG. 1B is a plan view of the arrangement according to FIG. 1A from above.
Figure 1C:
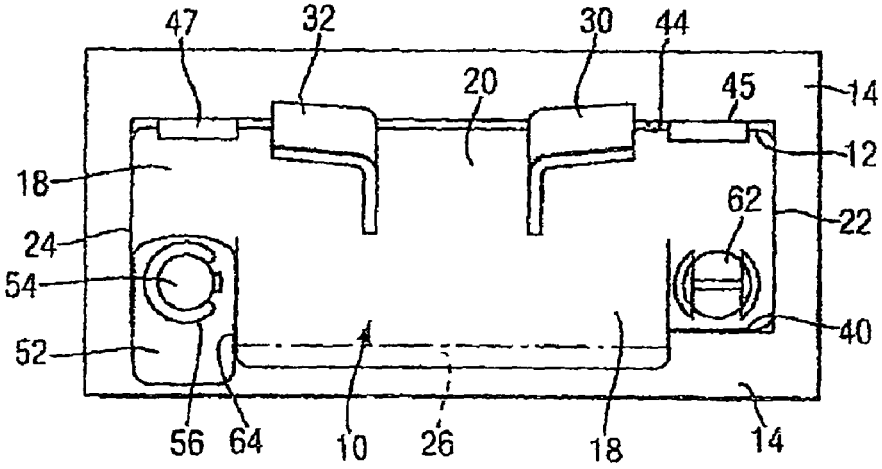
FIG. 1C is a rear view of the arrangement according to FIG. 1A.
Figure 1D:
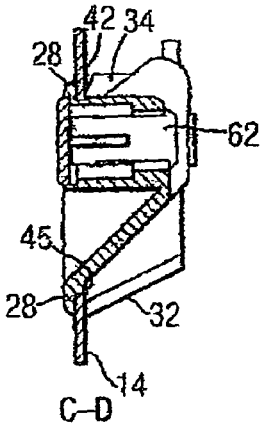
FIG. 1D is a sectional view along line C-D of FIG. 1A.
Figure 1E:
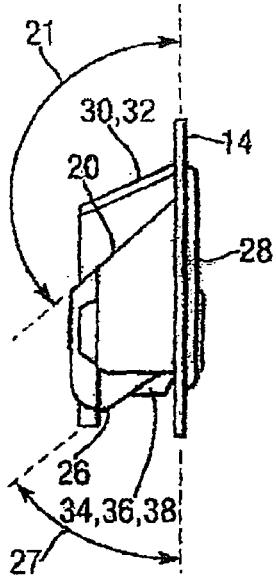
FIG. 1E is a view from the right-hand side of the arrangement according to FIG. 1D.
Figure 1F:
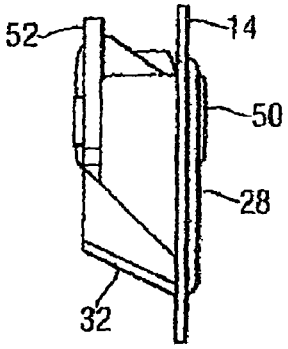
FIG. 1F is a side view from the left-hand side according to FIG. 1A.
Figure 1G:
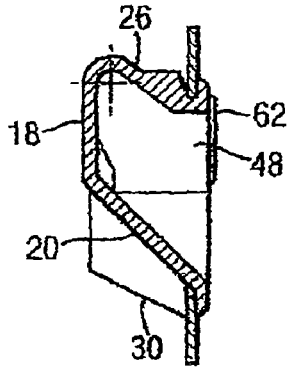
FIG. 1G is a sectional view along line A-B of FIG. 1A.
Figure 2:
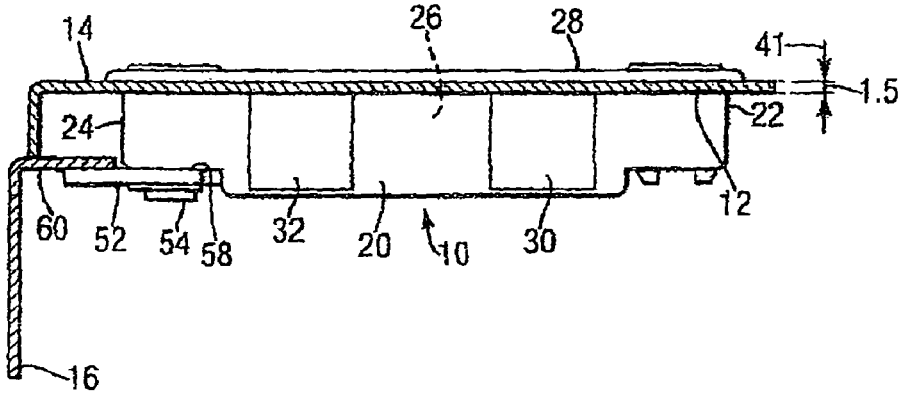
FIG. 2 is a cross-sectional view through a sheet-metal cabinet door fitted to a sheet-metal cabinet frame with a grip trough according to the invention.
Figure 3:
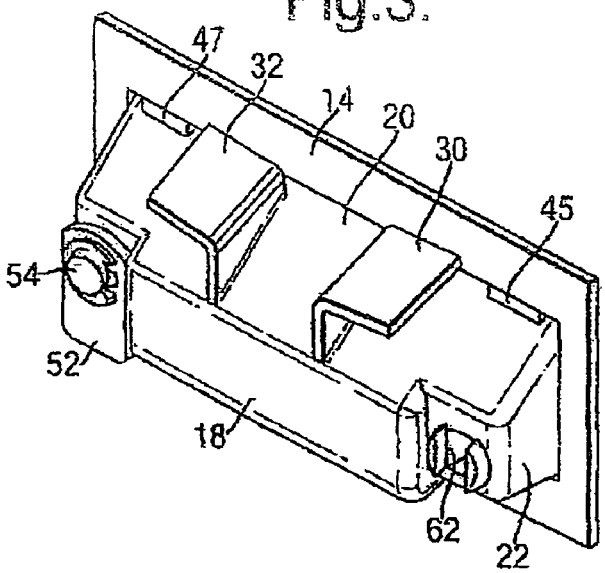
FIG. 3 shows a perspective rear view of the grip trough according to FIG. 2.
Figure 4:
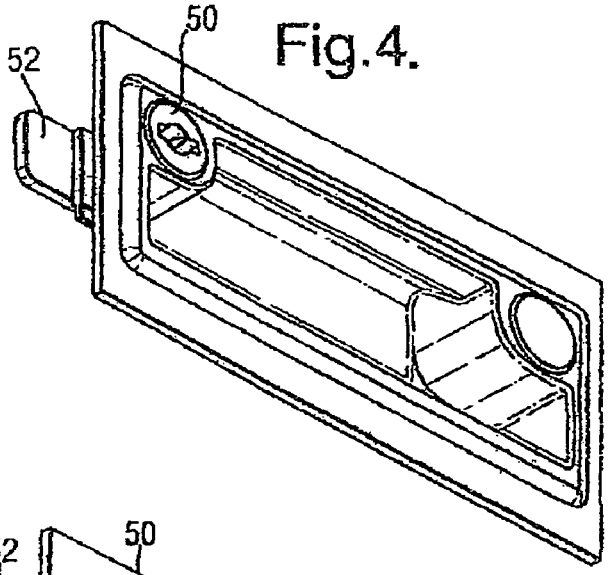
FIG. 4 shows another perspective view obliquely from the bottom and from the front of the grip trough according to the invention according to FIG. 2 with the closure device in the locked position.
Figure 5:
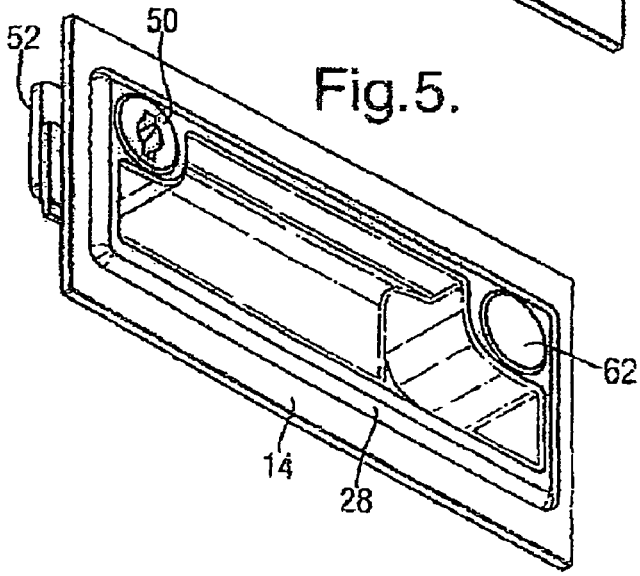
FIG. 5 shows a view similar to FIG. 4 but with the closure device in the open position.

FIG. 2 shows a grip trough 10 which is installed in a rectangular opening 12 of a thin wall 14 such as a sheet-metal wall or a door leaf of a sheet-metal cabinet comprising the door leaf and a door frame 16. As is shown in FIGS. 1A to 1G, the trough 10 comprises a base 18 and four side walls 20, 22, 24, 26 which proceed therefrom. These four side walls run into a rectangular flange-like rim 28 which surrounds the bearing surface of the opening 12 in the thin wall 14 in the mounted state. Two shorter, oppositely located side walls 22, 24 extend substantially parallel to one another and perpendicular to the thin wall 14, while the two other, longer side walls 20, 26 extend diagonally at an acute (27) and obtuse (21) angle, respectively, to the thin wall 14. Side-wall webs 30, 32 projecting in direction of the thin wall 14 from the side wall 20 that extends at an obtuse angle 21 to the thin wall 14 and projections 34, 36, 38 projecting in direction of the thin wall 14 from an opposite wall 26 are supported thereon, and the grip trough is securely held in the door opening in this way.

This grip trough 10 can be mounted in such a way that the grip trough 10 is initially placed over the opening edge 40 of the thin wall 14 by its slot 42, which is formed between the flange 28 and projection 34 and is tapered (to adapt to different sheet-metal thicknesses 41), and is then swiveled in direction of the opposite edge 44 by the opposite side wall 20 from which the wall webs 30, 32 proceed. These wall webs 30, 32, which are bent, are flexible and accordingly also allow for swiveling in, whereupon they spring back after passing through the opening 12 and contact the back side of the thin wall 14 so as to catch and, in this way, hold the grip trough securely in the opening 12 in cooperation with stop webs 45, 47.

Accordingly, the grip trough can be mounted in a similarly simple manner by snapping it in as in the prior art.

However, in contrast to the prior art, at least one receptacle 46 for a closure device such as a closing cylinder 50 is provided in the area of the side wall 26 extending at an acute angle to the thin wall 14. This closing cylinder 50 has a latch tongue or sash fastener 52 which is arranged on the shaft end 54 of the closing cylinder 50 as to be rigid against rotation and is held by a retaining ring 56, for example. The shaft 54 extends through an opening 58 in the base 18 of the grip trough 10 and, on its end which projects through, carries a shaft fastener tongue 52 or the like which lies behind the rear-engagement surface 60 of the door frame 18 or the like (see FIG. 2).

By means of this step, the door leaf 14 is pressed against the door frame 18 and held in a known manner assuming that the door leaf 14 is hinged on the door frame on the right-hand side with respect to FIG. 2 (not shown).

The grip trough can be designed in such a way that the receiving space 46, 48 for the closing cylinder 50 is arranged near the middle of the side wall 26 extending at an acute angle 27 to the thin wall 14, that is, approximately where the section line A-B is located in FIG. 1A. However, it can be seen from FIG. 1G, which shows the plan view of the section line A-B, that the receptacle 46, 48 then lies in the movement area for the hand that grasps the grip and presents an impediment. Therefore, it is better to move the receiving space for the closing cylinder to one of the two ends (shown on the left-hand and right-hand sides of FIG. 1A) as is shown in FIG. 1A.

In order to achieve a mirror-inverted construction which is advantageous for changing from the left-hand side to the right-hand side, two receiving spaces 46, 48 are provided for a respective closing cylinder 50 which lies, respectively, near the two ends of the side wall 26 extending at an acute angle to the thin wall 14. If only one closing cylinder is used, a filler plug arrangement or closing plug arrangement 62 could also be provided in the other receiving space instead of the closing cylinder in order to avoid an empty hole which could be annoying visually and for reasons relating to sealing (see FIG. 1D).

When the receiving spaces 46, 48 for the closing cylinder 50 or plug 62 are provided at the ends of the side wall 26 extending at an acute angle, it is also advantageous that the base 18 can spring back by an amount M such that a stop face 64 is formed for the rotating movement of the tongue or sash fastener 52.

In the construction shown in FIG. 1C, this would be an open position in which the door could be opened.

It is also advantageous when the base 18 springs back by an amount M such that the tongue 52, optionally including holding means for the tongues such as a retaining ring 56, nut, pin, or the like and including the end of the shaft 54 of the cylinder 50, are received in their entirety and do not project over the alignment line 49 of the rest of the base wall 18 which does not spring back.

COMMERCIAL APPLICABILITY

The invention is commercially applicable in switch cabinet construction.

While the foregoing description and drawings represent the present invention, it will be obvious to those skilled in the art that various changes may be made therein without departing from the true spirit and scope of the present invention.

REFERENCE NUMBERS

10 grip trough
12 rectangular opening
14 thin wall, door leaf
16 door frame
18, 118 base
20 side wall, obtuse angle
21 obtuse angle
22 side wall
24 side wall
26 side wall, acute angle
27 acute angle
28 flange-like rim
30 wall web
32 wall web
34 projection
36 projection
38 projection
40 opening edge
41 sheet-metal thickness
42 slot
44 opening edge
45 stop web
46 receptacle
47 stop web
48 receptacle
49 alignment line
50 closing cylinder
52 lock tongue, sash fastener
54 shaft end

56 retaining ring
58 opening
60 rear-engagement surface
62 closing plug
64 stop face
M amount

The invention claimed is:

1. A grip trough to be installed in a rectangular opening of a thin wall, wherein the trough comprises:

a base and four side walls proceeding therefrom, the four side walls running into a rectangular rim which surrounds a bearing surface of the opening in the thin wall in the installed state and extends away from the four side walls;

wherein two short, oppositely located side walls of said four side walls extend substantially parallel to one another and extend perpendicular to the thin wall; and wherein an acute angle long side wall and an obtuse angle long side wall of said four side walls are oriented diagonally at an acute angle and obtuse angle, respectively, relative to a back surface of the thin wall, the two long side walls being longer than the two short side walls;

wall webs, each of which projects from the obtuse angle long side wall in a respective first direction parallel to the thin wall; and a first receiving space for a closure device being provided in an area of the acute angle long side wall;

wherein said base is recessed by an amount in the area of the first receiving space provided in the acute angle long side wall and being constructed in such a way that a stop face is formed for a rotating movement of the closure device;

wherein a second receiving space for the closure device receives a filler plug instead of the closure device; and wherein the wall webs projecting from the obtuse angle long side wall are each bent away from the other at a free end and are supported on an inner rim surface of the opening by these bent portions, so that each wall web additionally extends in a respective second direction parallel to the thin wall that is different from the corresponding respective first direction.

2. The grip trough according to claim 1;

wherein said base is recessed by said amount such that a tongue of the closure device is received in its entirety by the recessed portion of the base, and does not extend beyond an alignment line of the rest of the base wall.

3. The grip trough according to claim 1;

wherein the closure device is a closing cylinder with a shaft; and wherein the closing cylinder is arranged in such a way that the closing cylinder projects by its shaft end through an opening in the base of the grip trough and carries a sash fastener tongue on its projecting end, and this sash fastener tongue is capable of engaging with a rear-engagement surface of a door frame.

4. The grip trough according to claim 1;

wherein the closure device is a closing cylinder; and wherein the first receiving space for the closing cylinder is provided near the center of the acute angle long side wall.

5. The grip trough according to claim 1;

wherein the first receiving space for the closure device is arranged near one end of the acute angle long side wall.

6. The grip trough according to claim 1;

wherein the first and second receiving spaces are provided, respectively, near one end and near the other end of the acute angle long side wall.

7. The grip trough according to claim 1;

wherein the grip trough is injection-molded from plastic in one piece.

8. The grip trough according to claim 1;

wherein the grip trough has projections projecting from the acute angle long side wall, the projections projecting in the direction of the thin wall and are supported on the thin wall and accordingly secure the grip trough in the opening.

9. The grip trough according to claim 8;

wherein the grip trough has a tapered slot between the rim and projections for receiving the opening edge of a thin wall of different sheet-metal thickness so as to be adapted thereto.

10. The grip trough according to claim 1;

wherein the grip trough, which has the wall webs which contact the back surface of the thin wall so as to catch and accordingly hold the grip trough securely in the opening, is provided with stop webs which cooperate with the wall webs.

* * * * *